United States Patent [19]

Murray

[11] 4,451,231

[45] May 29, 1984

[54] DRYING OF PARTICULATE MATERIAL

[75] Inventor: Lawrence K. Murray, Bartlesville, Okla.

[73] Assignee: Phillips Petroleum Company, Bartlesville, Okla.

[21] Appl. No.: 458,504

[22] Filed: Jan. 17, 1983

[51] Int. Cl.[3] ..... F27B 14/00; F27B 15/12; F27B 7/08; F26B 7/00

[52] U.S. Cl. ..... 432/13; 34/12; 432/16; 432/107; 432/112; 432/113

[58] Field of Search ..... 432/13, 16, 107, 112, 432/113; 34/12

[56] References Cited

U.S. PATENT DOCUMENTS

| | | | |
|---|---|---|---|
| 3,018,171 | 1/1962 | Pollock et al. | 23/314 |
| 3,251,137 | 5/1966 | Alleman | 34/31 |
| 3,384,974 | 5/1968 | Alleman et al. | 34/31 |
| 3,464,184 | 9/1969 | Wright | 55/97 |
| 3,482,327 | 12/1969 | Dutcher | 34/12 |
| 3,678,598 | 7/1972 | Quiles | 432/107 |
| 3,835,622 | 9/1974 | Henderson | 55/48 |
| 4,191,530 | 3/1980 | Bearce | 432/107 |
| 4,260,368 | 4/1981 | Karlsson | 432/13 |

*Primary Examiner*—John J. Camby

[57] ABSTRACT

A process for the removal of volatile liquid from particulate material employing indirect heating of the particulate material by means of combustion gases resulting from the combustion of sulfur-containing fuel, and further employing purging of the thus heated particulate material by means of combustion gases produced by the combustion of low sulfur fuel to remove vaporized volatile liquid from the particulate material. Also disclosed is a system for performing such removal of volatile liquid from particulate material.

15 Claims, 1 Drawing Figure

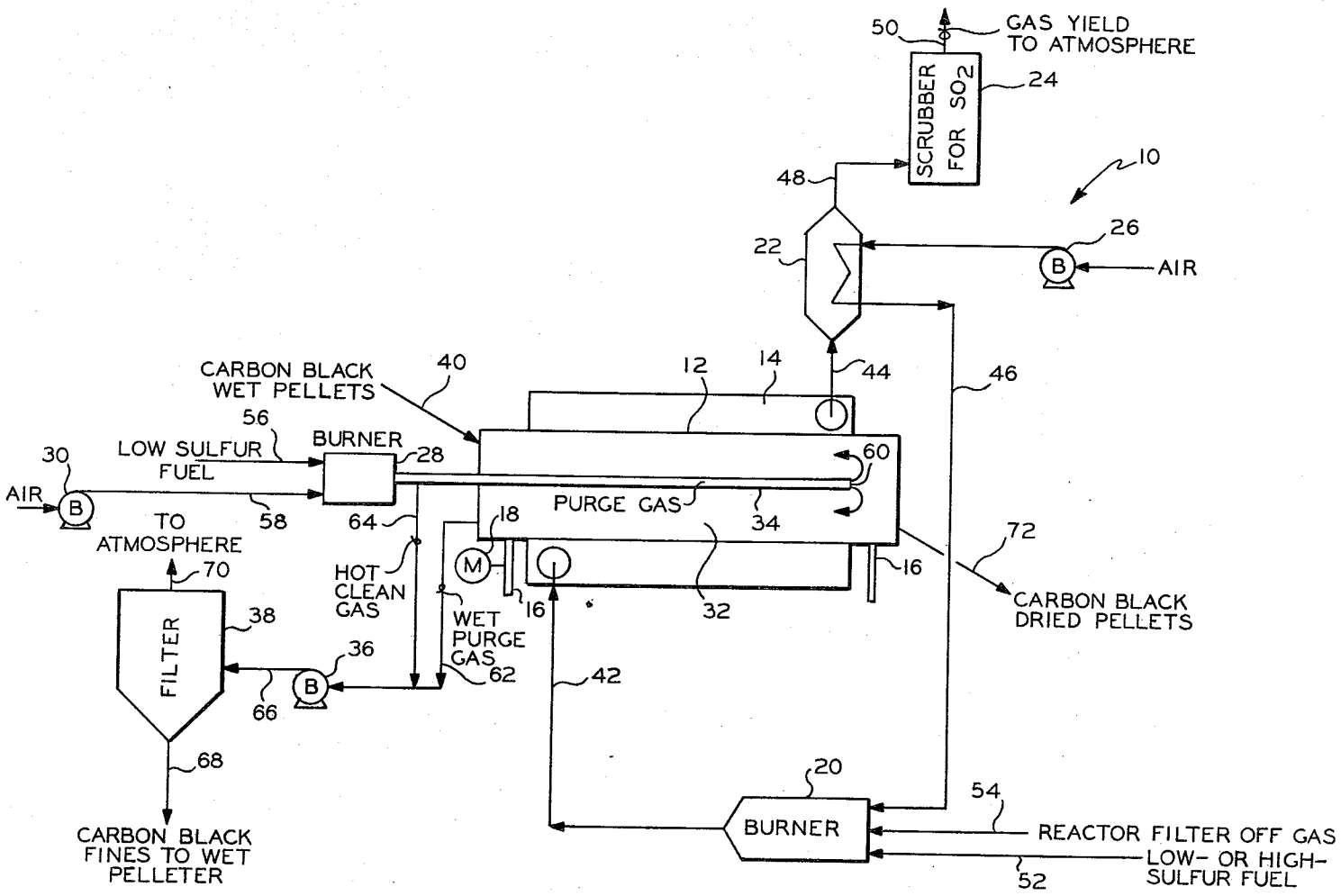
GAS YIELD TO ATMOSPHERE
SCRUBBER FOR $SO_2$
AIR
CARBON BLACK DRIED PELLETS
REACTOR FILTER OFF GAS
LOW- OR HIGH-SULFUR FUEL
BURNER
PURGE GAS
WET PURGE GAS
HOT CLEAN GAS
CARBON BLACK WET PELLETS
LOW SULFUR FUEL
TO ATMOSPHERE
FILTER
CARBON BLACK FINES TO WET PELLETER
10
12
14
16
18
20
22
24
26
28
30
32
34
36
38
40
42
44
46
48
50
52
54
56
58
60
62
64
66
68
70
72

DRYING OF PARTICULATE MATERIAL

This invention relates to removal of the volatile liquid from particulate material. In one aspect the invention relates to a process for removing liquid from particulate material. In another aspect the invention relates to apparatus for removing liquid from particulate material.

In some chemical processes, the resulting product is in the form of solid pellets which contain some residual moisture which must be removed in whole or in part. An example of such a product is ammonium nitrate fertilizer which is produced in the form of prills which require an additional drying step following the formation of the prill. In other processes, the product is formed in pellets which consist of very finely divided particles gathered together to make the individual pellets, which pellets often contain a relatively large amount of moisture which must be removed in a subsequent drying step. An example of this latter type of process is the production of carbon black utilizing a wet pelleting process in which the pellets have a moisture content of approximately 50%, which moisture content must be lowered to less than 1% in a subsequent drying step. It is important in such drying operations to make the most efficient use of the source of heat energy and the apparatus components utilized to prevent wasting fuel and to avoid excessive equipment installation costs. It is also improtant that such drying operations not only operate in the most efficient manner, but also meet the increasingly stringent emission regulations promulgated by various government agencies.

An object of the present invention is to remove a volatile liquid from particulate material.

Another object of the present invention is to make efficient use of heating fuel in a drying operation.

Yet another object of the present invention is to avoid excessive equipment installation costs for a drying operation.

Still another object of the present invention is to provide an efficient and effective process for drying particulate material which meets emission control regulations.

Another object of the present invention is to provide efficient and effective process and apparatus for drying wet pelleted carbon black.

Other aspects, objects and advantages of the present invention will be apparent in the following written description, the drawings and the appended claims.

In accordance with the present invention, a fuel is burned to provide combustion gases, and at least a portion of the thus provided gases is used to dry liquid-laden particulate material by contacting the particulate material within a drying zone. In one embodiment of the invention, a second portion of the combustion gases contacts the first portion of the combustion gases downstream of the drying zone. This second portion of the combustion gases assists in preventing condensation of the condensible vapor being borne by the first portion of the combustion gases by maintaining the temperature of the gases and liquid vapor above the condensation point of the condensible vapor.

The single FIGURE in the drawing is a schematic diagram illustrating the process and apparatus of the present invention.

Referring now to the drawing, a system for drying particulate material is illustrated therein and is generally designated by the reference character 10. The system 10 comprises a rotating dryer drum 12 disposed within an indirect heating chamber 14. The drum 12 is suitably supported on rollers 16 and is adapted to be rotated about its longitudinal axis in response to rotation imparted to at least a portion of the rollers 16 by suitable drive means such as a motor 18 to agitate the contents of the drum 12 which effects contacting of the pellets with the hot internal surface of the drum. Combustion gases to provide indirect heat to the exterior of the drum 12 are provided by a burner 20. An indirect heat exchanger 22 is provided for extracting heat from these combustion gases downstream of the heating chamber 14. A suitable scrubbing device 24 for removing $SO_2$ from these combustion gases is located downstream of the heat exchanger 22. The heat exchanger provides means for preheating combustion air for the burner 20, which air is provided by a suitable blower 26.

A second burner 28 receives low-sulfur fuel gas and/or low-sulfur liquid fuel from a suitable source and combustion air from a suitable blower 30. At least a portion of the resulting combustion gases from the burner 28 are fed to a drying zone 32 defined by the dryer drum 12 via a suitable conduit 34. A blower 36 is provided downstream of the conduit 34 for conveying the combustion gases and generated vapor to a suitable filter 38, such as a bag filter or a cyclone filter.

In operation, liquid-bearing particulate material, in this example wet carbon black pellets from conventional wet pelleting of flocculent carbon black, is charged to the rotating dryer drum 12 via conduit 40, which dryer drum is indirectly heated on its outer periphery by hot combustion gases from the burner 20. Such wet carbon black pellets are conventionally prepared from flocculent carbon black by using an aqueous pelleting solution comprising water and usually a minor amount of pelleting aid, e.g., a lignin sulfonate, molasses, and the like.

Hot combustion gases from the burner 20 are charged via conduit 42 to the indirect heating chamber 14 around the rotating dryer drum 12 to indirectly heat the interior of the drum containing the pellets. Suitable gases combusted in the burner 20 for this heating include low BTU off-gas (e.g., 50–100 BTU/standard cubic foot) from a carbon black plant filter system (main filter) along with such fuel as low-sulfur or high-sulfur natural gas, and/or low-sulfur or high-sulfur liquid fuel, and/or low-sulfur or high-sulfur liquid feedstock (charge stock for carbon black production) to ensure proper burning of the off-gas. Such off-gas is typically produced in a carbon black reactor to which is charged sulfur-containing make-oil or feed oil for production of carbon black, and such off-gas from the carbon black filter system contains sulfur compounds, including $SO_2$.

The used and cooled combustion gases exit the heating chamber 14 via conduit 44 and are further cooled in the indirect heat exchanger 22 wherein air from blower 26 to support combustion of the off-gas is preheated and then conveyed via conduit 46 to burner 20. The cooled combustion gases pass from the heat exchanger 22 via conduit 48 to the scrubbing device 24 for $SO_2$ removal, thereafter yielding the cleaned gas (low in $SO_2$) to the atmosphere via conduit 50.

The preheated air from conduit 46, low-sulfur or high-sulfur natural gas, and/or low-sulfur or high-sulfur liquid fuel, and/or low-sulfur or high-sulfur liquid feedstock (charge stock for carbon black production) from conduit 52 and off-gas from conduit 54 produce in burner 20 the hot combustion gases charged to indirect heating chamber 14 via conduit 42. These hot combustion gases are not also used as purge gases within the drying zone 32 of the dryer drum 12 as has been the conventional practice.

In the instant process, purge gas, substantially free of sulfur compounds, e.g., free of $SO_2$, is produced by charging substantially sulfur-free fuel, i.e., substantially free of sulfur and sulfur compounds, via conduit 56 and air from blower 30 via conduit 58 to the burner 28. The purge gas, in the form of hot combustion gases produced in the burner 28, exits the outlet end 60 of the conduit 34 which is positioned coaxially within and along the longitudinal axis of the rotating dryer drum 12.

The purge gas from the conduit 34 passes into direct contact with the hot pellets in the drying zone 32 of the rotating dryer drum 12 and removes the water (as vapor) which is evaporated from the wet pellets in wet purge gas which exits the drying zone 32 of the dryer drum 12 via conduit 62. This used, wet purge gas carries along with it some carbon black fines produced during the drying of the wet pellets in the dryer drum 12. This used purge gas, rich in water vapor, is tempered by addition thereto of a portion of the hot combustion gases from the burner 28 via conduit 64 so that the temperature of the resulting admixture of gases is high enough to prevent the condensation of water vapor in the purge gas filter 38. The used purge gas from conduit 42 is blended with a portion of the combustion gases from burner 28 and conduit 64, and the resulting admixture is charged via blower 36 and conduit 66 safely to the purge gas filter 38.

Carbon black is recovered from the bottom of the filter 38, preferably a bag filter, via conduit 68 for recycle to the wet pelleter (not shown) upstream of the conduit 40. The filtered purge gas, containing substantially no $SO_2$ or other sulfur compounds, can be vented directly to the atmosphere from the upper portion of the filter 38 via conduit 70 since such filtered gas comlies with ecological and environmental control requirements, and does not require any clean-up treatment.

Dried carbon black pellets containing usually less than about 0.5 weight percent water are recovered from the drying zone 32 of the dryer drum 12 via conduit 72.

The following is a calculated example in tabular form of the process of the present invention with reference being made to the system 10 illustrated in the drawing by reference characters within parentheses.

| | |
|---|---|
| (40) Wet Carbon Black Pellets: | |
| Water, pounds/hour, | 7,392 |
| Carbon Black, pounds/hour | 7,102 |
| Pounds/hour (Total) | 14,494 |
| Temperature, °F. | 180 |
| (72) Dried Carbon Black Pellets: | |
| Pounds/Hour | 7,118 |
| Wt. % water, | 0.5 |
| Temperature, °F. | 410 |
| (42) Hot Gases to Indirect Heating Chamber to Heat Dryer Drum (12) Externally: | |
| Temperature, °F. | 1,900 |
| Standard Cubic Feet/Hour[a], | 587,566 |
| Composition, Wt. % | |
| Oxygen, | 4.74 |
| Carbon Dioxide | 10.94 |
| Water Vapor, | 23.57 |
| Nitrogen, | 60.75 |
| $SO_2$, ppm by wt., | about 19,000 |
| (44) Used Gases from Indirect Heating Chamber (14): | |
| Temperature, °F. | 986 |
| (48) Cooled Used Gases from (22): | |
| Temperature, °F. | 782 |
| Cubic Feet/Hour at 782° F.[b] | 1,300,513 |
| Composition, Wt. % | |
| Oxygen, | 4.74 |
| Carbon Dioxide, | 10.94 |
| Water Vapor, | 23.57 |
| Nitrogen, | 60.75 |
| $SO_2$, ppm by wt., | about 19,000 |
| (56) Low Sulfur Fuel Gas: | |
| Sulfur, ppm by wt., as Sulfur, | 10 |
| Standard Cubic Feet/Hour[a], | 900 |
| Btu/Standard Cubic Feet, about | 970 |
| (30) Combustion Air for Burner 28: | |
| Standard Cubic Feet/Hour[a], | 24,720 |
| (34) Purge Gas at Exit (60) of (34): | |
| Temperature, °F., | 986 |
| Pounds/Hour, | 1,927 |
| (62) Used Purge Gas: | |
| Temperature °F., | 325 |
| Pounds/Hour[c], | 9,283 |
| (Carbon Black Carried, Pounds/Hour), | 20 |
| (64) Tempering Gas: | |
| Temperature, °F. | 986 |
| Pounds/Hour, | 460 |
| (66) Blended Gas to Filter (38): | |
| Temperature, °F., | 400 |
| Cubic Feet/Hour at 400° F., | 314,280 |
| Pressure in Filter, inches water | 11 |
| Composition, Wt. %, | |
| Oxygen, | 1.14 |
| Carbon Dioxide, | 2.64 |
| Water Vapor, | 81.55 |
| Nitrogen, | 14.67 |
| $SO_2$, ppm by wt., | 0.25 |
| (Carbon Black, Pounds/Hour) | 20 |
| (68) Recovered Carbon Black to Pelleting from Filter (38): | |
| Pounds/Hour, | 20 |
| (70) Gas to Atmosphere from Filter (38): | |
| Temperature, °F., | 400 |
| Cubic Feet/Hour at 400° F., | 314,280 |
| Pressure in Filter, inches $H_2O$, | 11 |
| Composition, Wt. % | |
| Oxygen, | 1.14 |
| Carbon Dioxide, | 2.64 |
| Water Vapor, | 81.55 |
| Nitrogen, | 14.67 |
| $SO_2$, ppm by wt., | 0.25 |
| (46) Preheated Air for Shell Heating: | |
| Temperature, °F., | 520 |
| Standard Cubic Feet/Hour[a], | 270,000 |
| (54) Carbon Black Reactor Off-Gas (Main Filter): | |
| Temperature, °F., | 450 |
| Cubic Feet/Hour | 344,000 |
| Btu/Standard Cubic Feet containing 48 volume % water), | 56.2 |
| Sulfur, ppm by wt., | 16,432 |
| (52) Natural Gas: | |
| Sulfur, ppm by wt., | 10 |
| Temperature, °F., | 60 |
| Standard Cubic Feet/Hour[a], | 400 |
| Btu/Standard Cubic Feet, about | 970 |

[a]Measured at 1 atmosphere and 60° F.
[b]Normally there is some leakage of gases from the dryer shell
[c]Includes water removed from wet pellets When, as conventionally practiced, a portion of the shell heating gas from burner 20 is used as the purge gas within the drying zone 32, this sulfur-containing gas must be scrubbed for $SO_2$ removal. By the present invention, the elimination of scrubbing the used purge gas occasioned by employing very low-sulfur fuel to produce the purge gas saves about 9,743 pounds/hour (about 190,000 standard cubic feet/hour) of gas charged to the $SO_2$ scrubber. Conventionally, about 46,832 pounds/hour (about 734,500 standard cubic feet/hour) of $SO_2$-containing gas would be required to be scrubbed for $SO_2$ removal to meet the ecological and environmental requirements for $SO_2$ in gases vented to the atmosphere. By the present invention, treating expense is reduced by about 25%, as illustrated in the calculated example above.

The $SO_2$ scrubbing device 24 of the present invention typically utilizes aqueous caustic or the like, and is well known in the art for removing $SO_2$ from gases.

Reasonable variations and modifications are possible within the scope of the foregoing disclosure and the drawing without departing from the spirit and scope of the present invention as limited only by the following claims.

I claim:

1. A process for removing volatile liquid from liquid-laden particulate material, comprising:

introducing said liquid-laden particulate material into a drying zone defined by a closed vessel having an exterior and an interior;

burning a first mixture comprising air and a first fuel to produce first hot combustion gases;

contacting the exterior of said vessel with said first hot combustion gases to heat the interior of said vessel and thereby vaporize volatile liquid therein;

burning a second mixture comprising air and a second fuel to produce second hot combustion gases, said second fuel containing substantially less sulfur and sulfur compounds than said first fuel;

passing a first quantity of said thus produced second hot combustion gases through the interior of said vessel to purge the vaporized volatile liquid from said drying zone; and thereafter filtering said second hot combustion gases and said thus purged vaporized volatile liquid to separate therefrom particulate material entrained therein.

2. A process in accordance with claim 1 characterized further to include the step of:

agitating said particulate material in said drying zone.

3. A process in accordance with claim 1 where said second fuel comprises a fuel which is substantially free of sulfur and sulfur compounds.

4. A process in accordance with claim 1 characterized further to include:

venting the thus filtered second hot combustion gases and vaporized volatile liquid to atmosphere.

5. A process in accordance with claim 1 characterized further to include introducing a second quantity of said second hot combustion gases into said first quantity of said second hot combustion gases and said thus pruged vaporized volatile liquid subsequent to said passing step and prior to said filtering step.

6. A process in accordance with claim 1 wherein said second fuel comprises a fuel which is substantially free of sulfur and sulfur compounds, and wherein said process is characterized further to include:

venting the thus filtered second hot combustion gases and vaporized volatile liquid to atmosphere.

7. A process in accordance with claim 6 characterized further to include introducing a second quantity of said second hot combustion gases into said first quantity of said second hot combustion gases and said thus purged vaporized volatile liquid subsequent to said purging step and prior to said filtering step.

8. A process in accordance with claim 7 characterized further to include the step of agitating said particulate material in said drying zone.

9. A process in accordance with claim 8 wherein said particulate material comprises carbon black.

10. A process in accordance with claim 9 wherein said volatile liquid comprises water.

11. A dryer for removing volatile liquid from particulate material, comprising:

a rotary drum;

means for feeding volatile liquid-laden particulate material into said drum;

means for rotating said drum to move said particulate material in said drum;

means for generating first sulfur-containing combustion gases from at least one sulfur-containing fuel and applying said thus generated first combustion gases to the exterior of said drum to heat the interior of said drum and said particulate material therein; and means for generating second substantially sulfur-free combustion gases and passing at least a first portion of said thus generated second combustion gases through the interior of said drum to purge the vaporized volatile liquid form said drum.

12. A dryer in accordance with claim 11 characterized further to include means for admixing a second portion of said second combustion gases with said first portion of said second combustion gases and purged vaporized volatile liquid downstream of said drum so as to maintain the temperature of the thus admixed gases and vaporized volatile liquid above the condensation temperature of said vaporized volatile liquid.

13. A dryer in accordance with claim 11 wherein said means for generatig first sulfur-containing combustion gases includes means for receiving and combusting off-gases produced in the manufacture of said particulate material.

14. A dryer in accordance with claim 11 characterized further to include filter means in fluid flow communication with said drum for receiving said second combustion gases and purged vaporized volatile liquid from said drum, separating said gases and vaporized volatile liquid from any of said particulate material entrained therein and venting said gases and said vaporized volatile liquid to atmosphere.

15. A dryer in accordance with claim 14 characterized further to include gas scrubber means in fluid flow communication with said first sulfur-containing combustion gases downstream of said retary drum for separating sulfur-containing compounds from said gases and venting said thus scrubbed gases to atmosphere.

* * * * *